US007845834B2

(12) United States Patent
Hou

(10) Patent No.: US 7,845,834 B2
(45) Date of Patent: Dec. 7, 2010

(54) LIGHTING SYSTEM WITH AN ADJUSTABLE ILLUMINATED AREA

(75) Inventor: Sheng-Fa Hou, Hsinchu (TW)

(73) Assignee: Lite-On It Corporation, Taipei (TW)

( * ) Notice: Subject to any disclaimer, the term of this patent is extended or adjusted under 35 U.S.C. 154(b) by 238 days.

(21) Appl. No.: 12/256,697

(22) Filed: Oct. 23, 2008

(65) Prior Publication Data

US 2009/0122547 A1 May 14, 2009

(30) Foreign Application Priority Data

Nov. 13, 2007 (CN) ..... 2007 1 0168147

(51) Int. Cl.
*F21V 5/00* (2006.01)

(52) U.S. Cl. ..... 362/331; 362/308; 362/277; 362/280

(58) Field of Classification Search ..... 362/16–18, 362/268, 270–271, 277, 332, 333, 336, 338, 362/280–282, 331, 308
See application file for complete search history.

(56) References Cited

U.S. PATENT DOCUMENTS 3,894,227 A * 7/1975 Pitkjaan et al. ..... 362/543
4,345,303 A * 8/1982 Gerard et al. ..... 362/512
5,068,768 A * 11/1991 Kobayashi ..... 362/539
5,555,492 A * 9/1996 Feger ..... 362/293

* cited by examiner

*Primary Examiner*—Jong-Suk Lee
*Assistant Examiner*—Robert J May
(74) *Attorney, Agent, or Firm*—Thomas, Kayden, Horstemeyer & Risley, LLP

(57) ABSTRACT

The present invention discloses a lighting system with an adjustable illuminated area. The lighting system comprises a light source for outputting a light, a first refractive optical element and a second refractive optical element. The first and second refractive optical elements have continuous curvature. The first refractive optical element is movable along a first direction, while the second refractive optical element is movable along a second direction. The light passes through the first refractive optical element and the second refractive optical element to form an illuminated area. The shape and the size of the illuminated area are adjusted when the relative position of the first refractive optical element and the second refractive optical element is adjusted.

12 Claims, 6 Drawing Sheets

LIGHTING SYSTEM WITH AN ADJUSTABLE ILLUMINATED AREA

FIELD OF THE INVENTION

The present invention relates to the adjustment for an illuminated area of a lighting system and more particularly to the adjustment for the size and shape of the illuminated area of a lighting system.

BACKGROUND OF THE INVENTION

Nowadays lighting systems or stage lights on the market are with the function of adjusting the size or the shape of their illuminated areas. Take stage lights for example, the size and the shape of the illuminated area are adjusted according to performer's show on the stage in order to attain perfect light effects.

The prior art for adjusting the size and the shape of the illuminated area of a lighting system are classified as following:

(1) Two optical elements are rotated around or moved about the incident optical axis so that the size of the illuminated area is adjusted. U.S. Pat. No. 4,101,957 discloses an illuminating lamp which provides for varying both the intensity of light output and the size of the illuminated area. The intensity of light output and the size of the illuminated area are varied by moving the position of a lens which is on the incident optical axis. Moreover, U.S. Pat. No. 5,584,568 discloses a lighting apparatus which has a lighting filament, a first lens disposed at a fixed distance from the filament and a sleeve carrying a second lens for sliding relative to the box. The size of the illuminated area varies with the position of the second lens. However, the prior art mentioned above may only adjust the size of the illuminated area. The shape of the illuminated area can not be adjusted.

(2) The relative positions of optical elements which are along the incident optical axis are adjusted so that the size and the intensity distribution of the illuminated area are adjusted. U.S. Pat. No. 6,986,593 discloses a lighting system which provides for varying the size of the illuminated area. The radiated angle of the light source, i.e. light emitter diode module, is varied by adjusting the position of an object lens so that the size of the illuminated area is varied. In addition, U.S. Pat. No. 6,866,401 discloses a lamp which provides for varying the size of the illuminated area. The light source of the lamp also adopts light emitter diode module. The illuminated area of the lamp is varied when the light source driven by a zoom apparatus is moved forward or backward. The zoom apparatus is slidably adjustable or rotatably adjustable. However, the prior art mentioned above may only adjust the size of the illuminated area. The shape of the illuminated area can not be adjusted.

(3) Optical elements of a lighting system are interchanged so that the light path is changed and the shape of the illuminated area is therefore changed. U.S. Pat. No. 4,608,622 discloses a multi-functional optical source which changes the light path by a complicated mechanical assembly, i.e. a turn table. The turntable is rotatable to different predetermined positions relative to a collimated light source to produce selectable illuminated shape. U.S. Pat. No. 4,400,765 discloses an operating room light fixture with adjustable light pattern. The light path passes different reflect bodies and the illuminated shape is thus varied because the light path is changed. However, the prior art mentioned above adopts too many mechanical assemblies so that the lighting system is complicated and costs a lot of money. Moreover, the interchange of the illuminated shape is not continuous and not smooth because the physical limitation of the mechanical assemblies. Users feel less comfortable when adjusting the illuminated shape.

(4) Light emitter diode modules are controlled to produce different illuminated shape. U.S. Pat. No. 3,648,706, U.S. Pat. No. 4,392,187, and U.S. Pat. No. 6,796,690 all disclose a lighting system wherein its light source adopts a great number of light emitter diode groups and its control system are composed of control circuits and complex mechanisms. The control system controls the great number of light emitter diode groups to adjust the illuminated shape, the size of the illuminated area, the illuminated intensity and the illuminated direction. However, the prior art mentioned above adopts too many illuminants and the control system (control circuits and mechanisms) are too complicated.

(5) A projection light is interrupted by a rotatable disc which carries different patterns to adjust the size and the shape of an illuminated area of a lighting system. U.S. Pat. No. 5,665,305 discloses a lighting system equipped with a number of rotatable discs wherein each disc may carry a plurality of lens elements. The light passes through the discs and then projects on the illuminated area. Therefore when the light passes through different discs, the shape or the size of the illuminated area are changed according to the lens elements of the disc chosen by the user. U.S. Pat. No. 6,048,080 discloses a lighting system equipped with a rotatable disc wherein the disc carries a number of different lens elements. The light passes through the discs and projects on the illuminated area. Users may rotate the disc to choose a desired lens element. When the light passes through the chosen lens element, the shape or the size of the illuminated area are thus changed. Although the prior art mentioned above may adjust the illuminated shape, the interchange of the illuminated shape is not continuous and not smooth because the physical limitation of the mechanical assemblies. Users feel less comfortable when adjusting the illuminated shape.

In view of the above prior arts, although the size or the shape of the illuminated area is adjusted, the mechanical design or the control circuits of the lighting system are very complex. Moreover, the light sources in some prior arts adopt a great number of light emitter diodes and thus lighting systems require higher cost. The prior arts don't conform to the design trend of the lighting systems under present enterprises' requirements, cost down for example. Therefore, a solution of continuously and smoothly adjusting the size or the shape of the illuminated area is the subject matter of the present invention.

SUMMARY OF THE INVENTION

It is an object of the present invention to provide a lighting system with an adjustable illuminated area therefore problems resulted from the prior arts are thus improved.

The present invention discloses a lighting system with an adjustable illuminated area. The lighting system comprises a light source for outputting a light, a first refractive optical element and a second refractive optical element. The first and second refractive optical elements have continuous curvature. The first refractive optical element is movable along a first direction, while the second refractive optical element is movable along a second direction. The light is irradiated through the first refractive optical element and the second refractive optical element to form an illuminated area. The shape and the size of the illuminated area are adjusted when the relative position of the first refractive optical element and the second refractive optical element is adjusted.

According to the claimed invention, the surfaces of the first refractive optical element and the second refractive optical element both carry a convex region, a flat region and a concave region respectively.

According to the claimed invention, the size of the illuminated area is reduced when the light is irradiated through the convex region of the first refractive optical element and the convex region of the second refractive optical element.

According to the claimed invention, the size of the illuminated area is enlarged when the light is irradiated through the concave region of the first refractive optical element and the concave region of the second refractive optical element.

According to the claimed invention, the shape of the illuminated area becomes elliptic when the light is irradiated through the concave region of the first refractive optical element and the convex region of the second refractive optical element.

According to the claimed invention, the shape of the illuminated area becomes elliptic when the light is irradiated through the convex region of the first refractive optical element and the concave region of the second refractive optical element.

According to the claimed invention, the first refractive optical element and the second refractive optical element are rectangular.

BRIEF DESCRIPTION OF THE DRAWINGS

The above contents of the present invention will become more readily apparent to those ordinarily skilled in the art after reviewing the following detailed description and accompanying drawings, in which.

DETAILED DESCRIPTION OF THE PREFERRED EMBODIMENT

A lighting system embedded with complex optical systems, mechanical assemblies and control circuits may adjust the size or the shape of its illuminated area. However, this kind of configuration for the lighting system requires higher cost and the adjustment is not continuous and not smooth. Therefore, a solution of improving the above problems, a lighting system with an adjustable illuminated area is disclosed.

Figure 1:
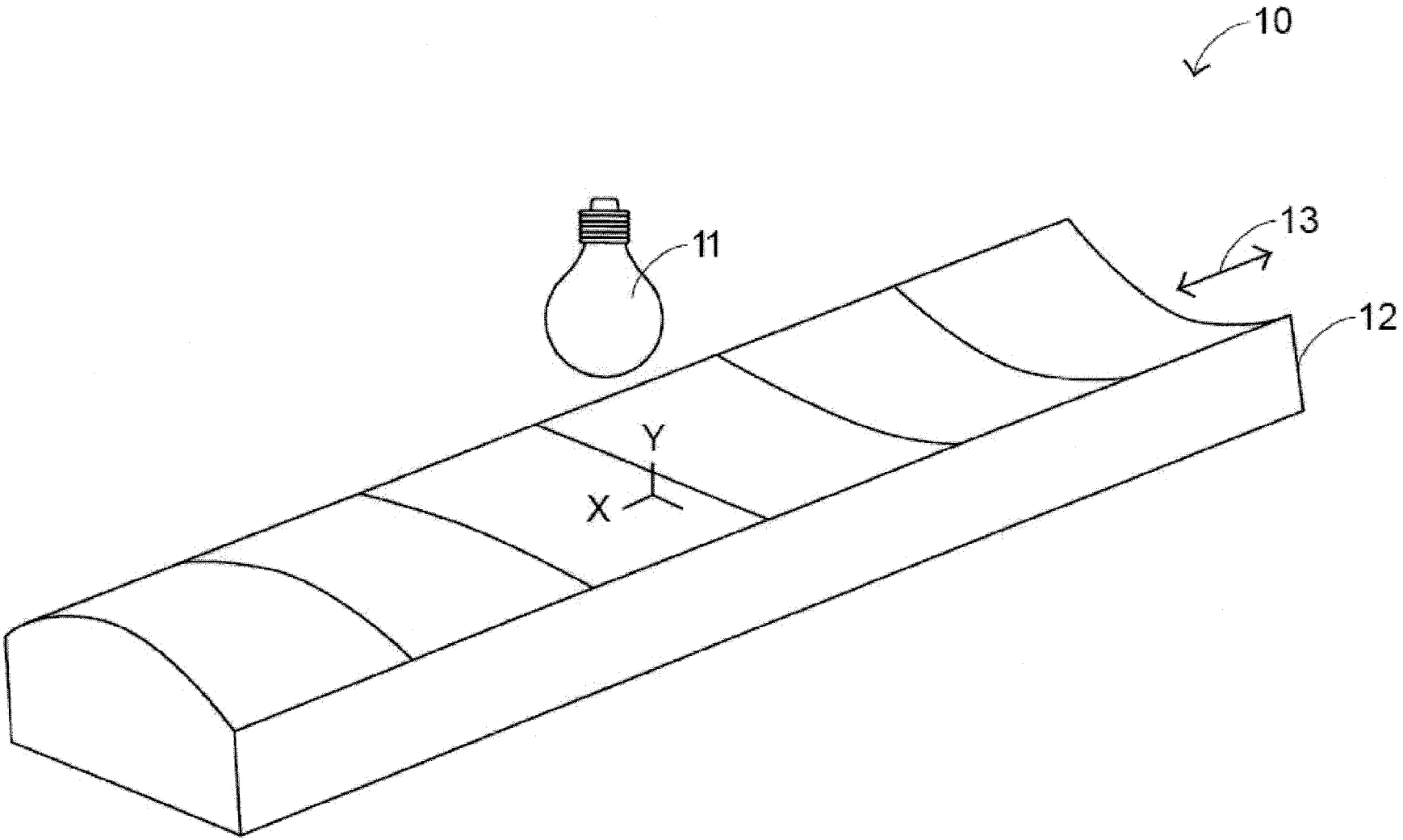
FIG. 1 is a diagram illustrating a lighting system according to the first embodiment of the present invention.

Refer to FIG. 1, which illustrates a lighting system according to the first embodiment of the present invention. The lighting system 10 comprises a light source 11 for outputting a light and a refractive optical element 12. The surface of the refractive optical element 12 is composed of a continuous curvature. The refractive optical element 12 is movable along the direction 13 as shown in FIG. 1. The light from the light source 11 passes through the refractive optical element 12 to form the illuminated area and the size of the illuminated area of the lighting system 10 varies with the curvature of the refractive optical element 12.

Figure 2:
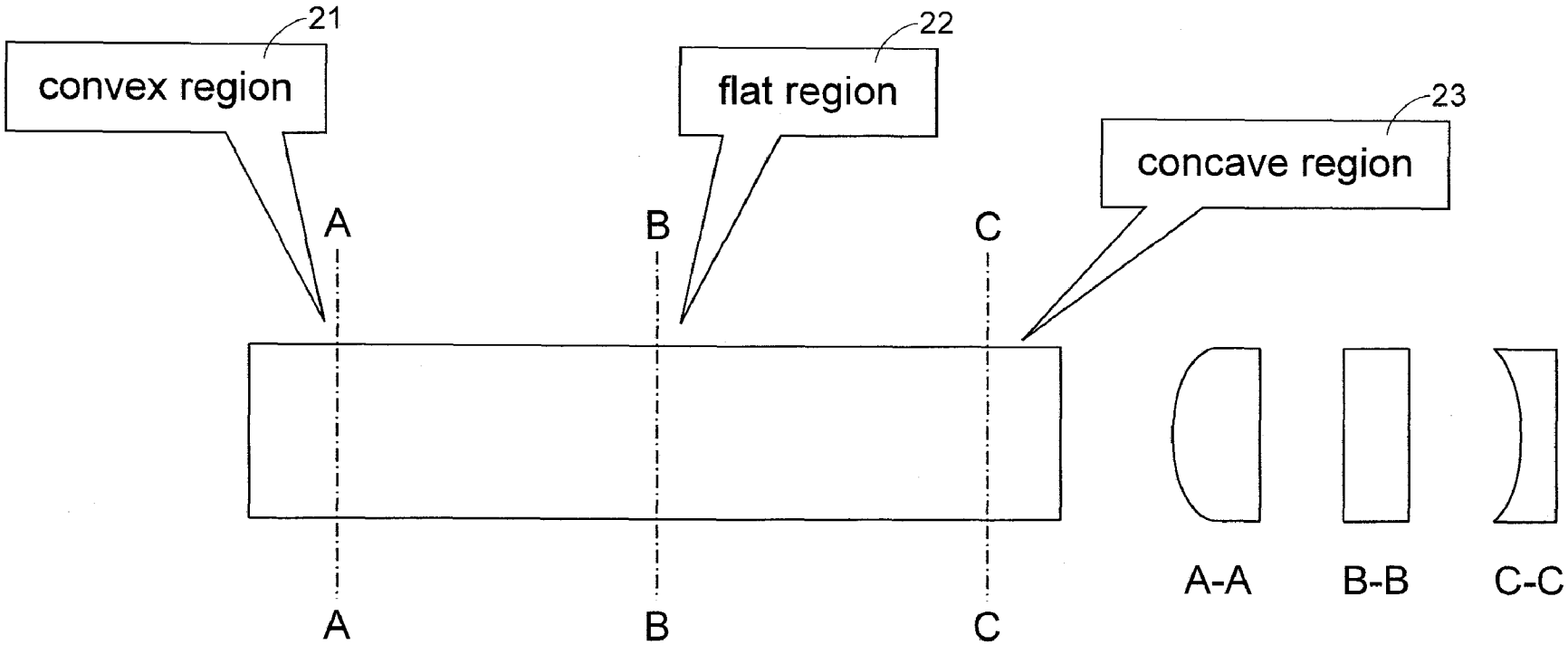
FIG. 2 is a diagram illustrating the continuous curvature of the refractive optical element shown in FIG. 1.

Refer to FIG. 2, which illustrates the cross-sectional view of the refractive optical element 12. The left part of the refractive optical element 12 is a convex region 21 as shown by section A-A. The middle part of the refractive optical element 12 is a flat region 22 as shown by section B-B. And the right part of the refractive optical element 12 is a concave region 23 as shown by section C-C. The size of the illuminated area is reduced when the light passes through the convex region 21 of the refractive optical element 12 because the convex lens focuses light. On the contrary, the size of the illuminated area is enlarged when the light passes through the concave region 23 of the refractive optical element 12 because concave lens diverges light. And the size of the illuminated area is not affected when the light passes through the flat region 22 of the refractive optical element 12. Therefore, the size of the illuminated area of the lighting system varies with the continuous curvature of the refractive optical element 12 when the refractive optical element 12 moves along the direction 13.

Figure 3:
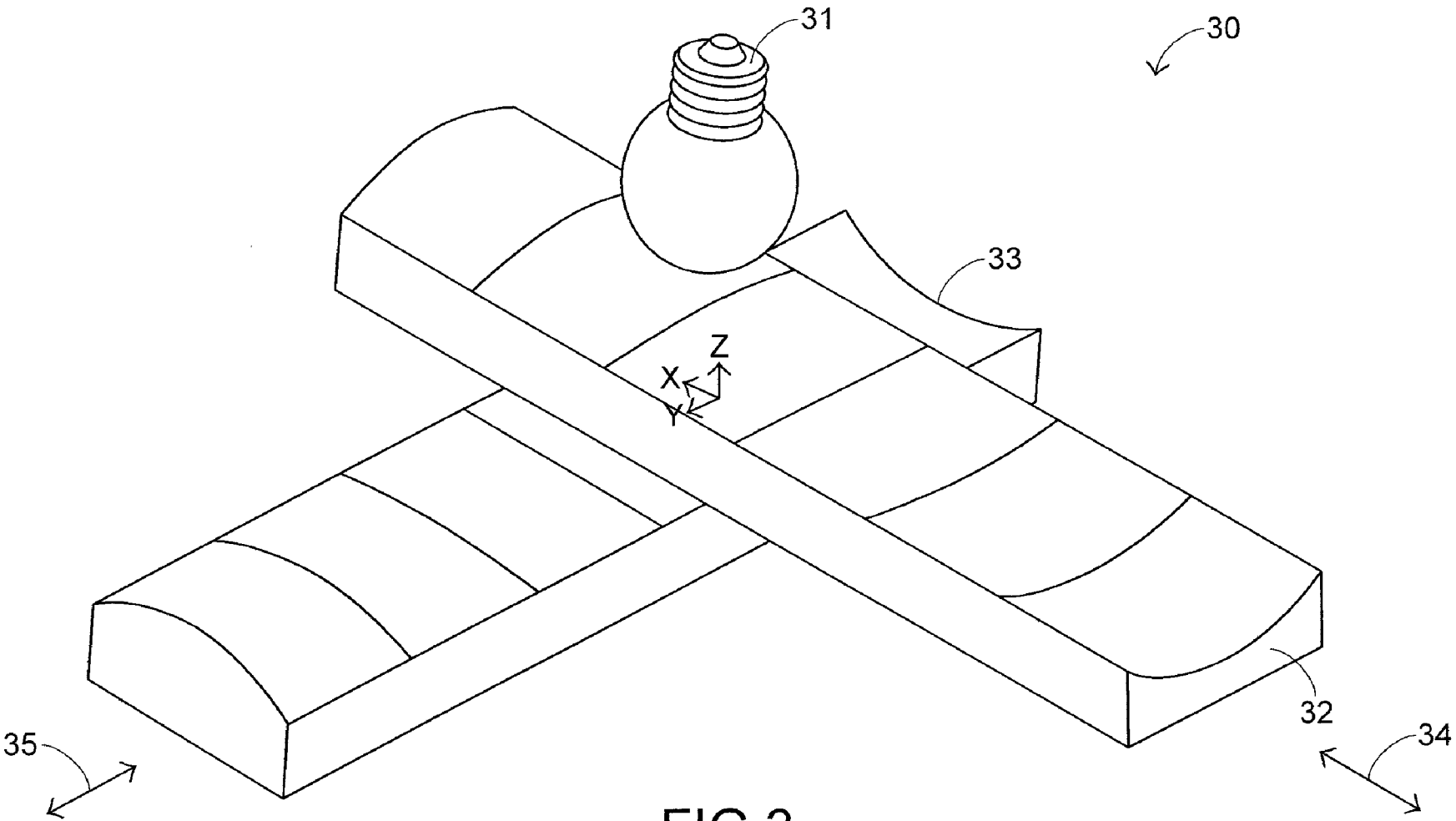
FIG. 3 is a diagram illustrating a lighting system according to the second embodiment of the present invention.

Refer to FIG. 3, which illustrates a lighting system according to the second embodiment of the present invention. The lighting system 30 comprises a light source 31, a first refractive optical element 32 and a second refractive optical element 33. Similar with the refractive optical element 12 of the first embodiment, the first refractive optical element 32 and the second refractive optical element 33 are both composed of a continuous curvature. That is to say, the surfaces of the first refractive optical element 32 and the second refractive optical element 33 both carry a convex region, a flat region and a concave region respectively. In addition, the first refractive optical element 32 and the second refractive optical element 33 are disposed perpendicularly. The first refractive optical element 32 is movable along the first direction 34 (x axis) while the second refractive optical element 33 is movable along the second direction 35 (y axis). When the lighting system 30 controls the first refractive optical element 32 and the second refractive optical element 33 moving along directions 34 and 35, the relative position of the first refractive optical element 32 and the second refractive optical element 33 varies so that the size or the shape of the illuminated area of the lighting system 30 varies.

Figure 4C:
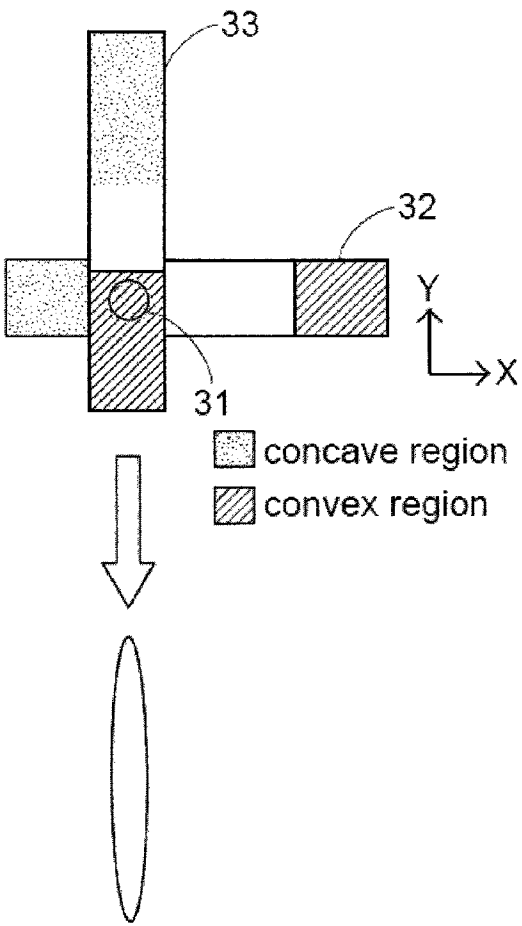
FIGS. 4A to 4C are diagrams illustrating how the lighting system adjusts the size or the shape of the illuminated area according to the second embodiment of the present invention.
Figure 4B:
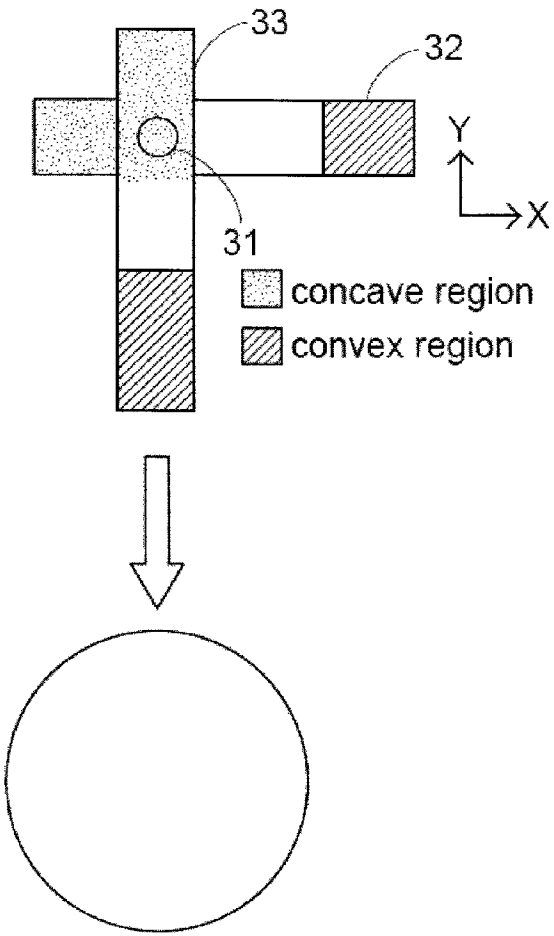
Figure 4A:
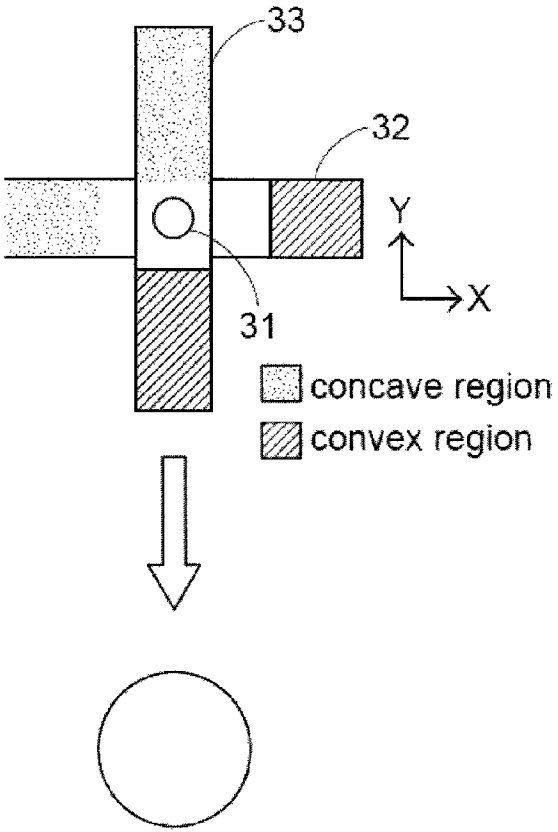

Refer to FIGS. 4A to 4C, which illustrate how the lighting system adjusts the size or the shape of the illuminated area according to the second embodiment. When the light is irradiated onto the flat regions of the first refractive optical element 32 and the second refractive optical element 33 to form the illuminated area, the illuminated shape is round as shown in FIG. 4A. When the light is irradiated onto the concave regions of the first refractive optical element 32 and the second refractive optical element 33 to form the illuminated area, the illuminated shape is round and the size of the illuminated area is enlarged as shown in FIG. 4B because concave lens diverges light. Refer to FIG. 4C, which illustrates the size and the shape of the illuminated area when the light is irradiated onto the concave region of the first refractive optical element and the convex region of the second refractive optical element to form the illuminated area. The illuminated area in the first direction (x axis) has larger size while the illuminated area in the second direction (y axis) has smaller size. The illuminated area is an ellipse with x axis longer because the affection of the curvatures of the two refractive optical element 32, 33. In the same way, if an ellipse shape with y axis longer is required, the two refractive optical elements 32, 33 are moved so that the light is irradiated onto the convex region of the first refractive optical element 32 and the concave region of the second refractive optical element 33.

Hence the size and the shape of the illuminated area are adjusted by moving the first refractive optical element 32 along the first direction and moving the second refractive optical element 33 along the second direction. If a smallest size of the illuminated area is required, the light is irradiated onto the convex regions of the first refractive optical element 32 and the second refractive optical element 33. On the contrary, if a largest size of the illuminated area is required, the light is irradiated onto the concave regions of the first refractive optical element 32 and the second refractive optical element 33 to form the illuminated area. Moreover, if the user wants to adjust illuminated shape, the light is controlled to be irradiated onto the convex region of the first refractive optical element 32 and the concave region of the second refractive optical element 33 or onto the concave region of the first refractive optical element 32 and the convex region of the second refractive optical element 33.

It is to be noted that the curvature variation of the refractive optical element's surfaces used in the present invention is continuous (convex region, then flat region to concave region). Thus if the user wants to adjust the size or the shape of the illuminated area, the refractive optical elements of the lighting system are moved and the variation of the size and the shape of the illuminated area is gradually changed. Users feel more comfortable when adjusting the size or the shape of the illuminated area. However, the curvature variation can also be convex region, then concave region to flat region. The sequence of convex region, concave region and flat region can be changed arbitrary as long as the curvature variation between the three regions is continuous and smooth.

Figure 5:
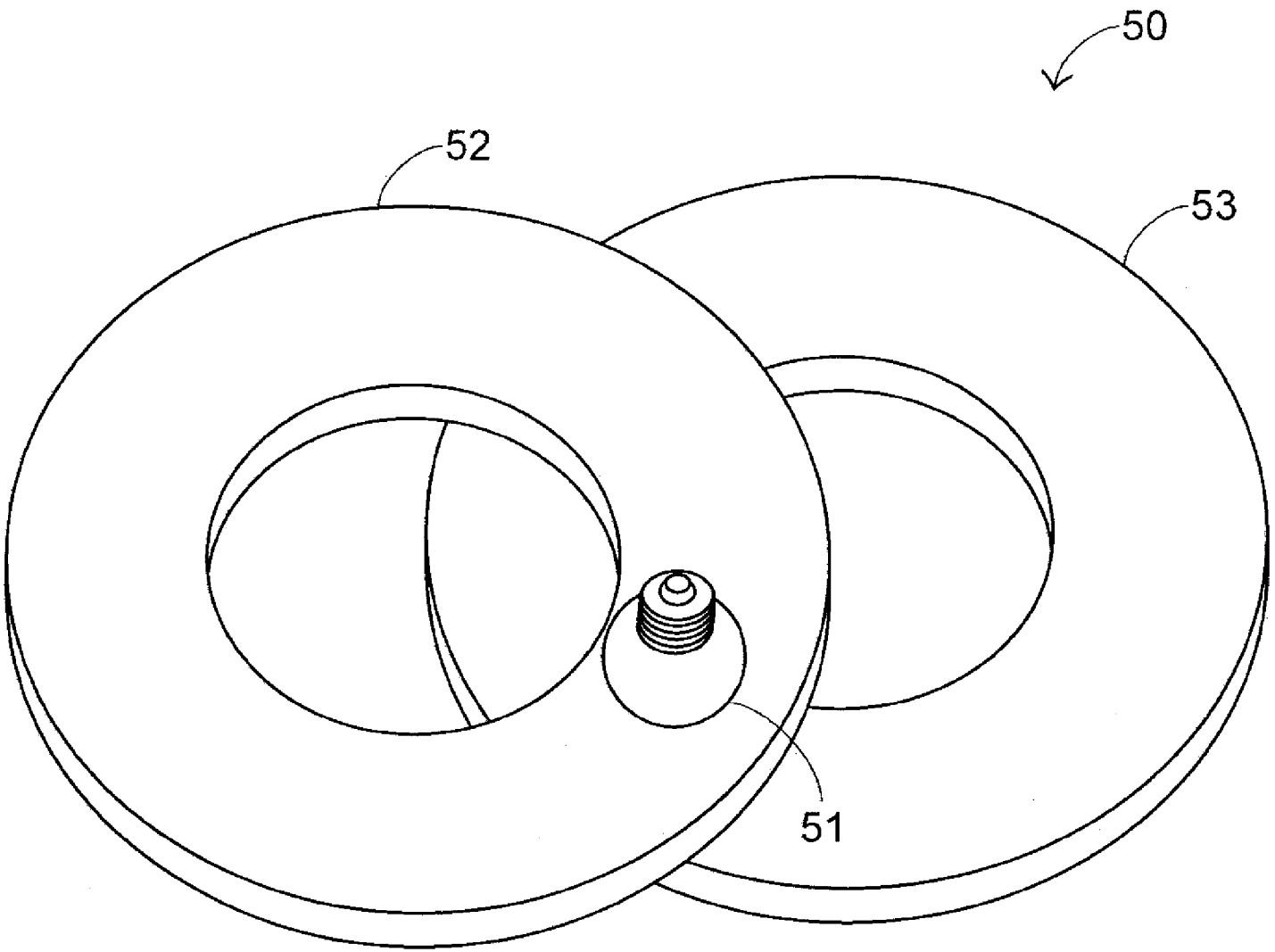
FIG. 5 is a diagram illustrating a lighting system according to the third embodiment of the present invention.

Refer to FIG. 5, which illustrates a lighting system according to the third embodiment of the present invention. The lighting system 50 comprises a light source 51, a third refractive optical element 52 and a fourth refractive optical element 53. In comparison with the refractive optical elements which are rectangular in the first embodiment and the second embodiment, the refractive optical elements 52, 53 in the present embodiment are circular-ringed. Similar with the rectangular refractive optical elements, the circular-ringed refractive optical elements 52, 53 are both composed of a continuous curvature. That is to say, the surfaces of the third refractive optical element 52 and the fourth refractive optical element 53 both carry a convex region, a flat region and a concave region respectively. In the second embodiment, the refractive optical elements move along two directions, respectively and in the third embodiment, the circular-ringed refractive optical elements 52, 53 rotate so that the light is irradiated onto different curvatures of the refractive optical elements 52, 53. The adjustment of the size and the shape of the illuminated area is similar to the second embodiment and is omitted here.

Figure 6:
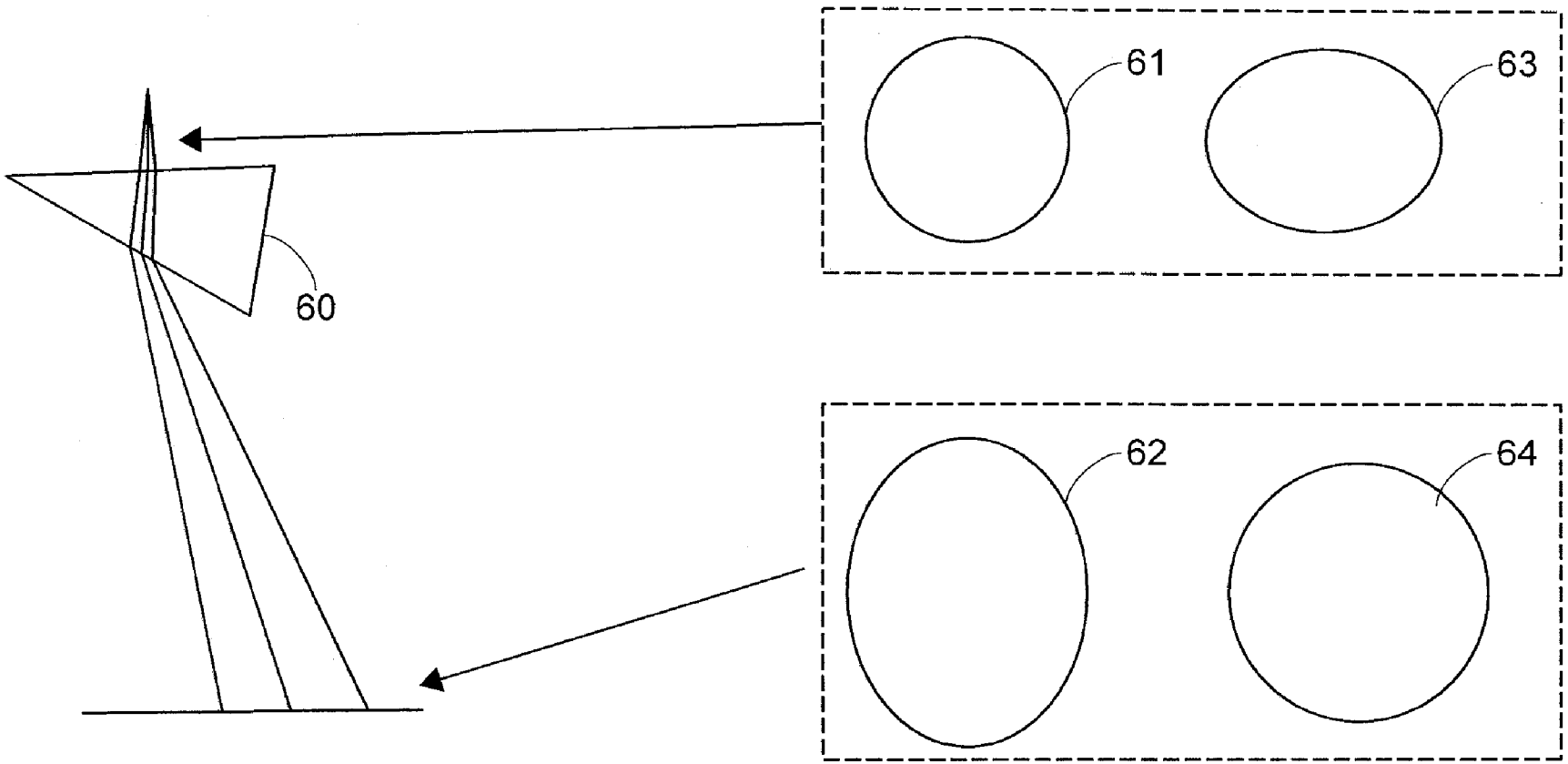
FIG. 6 is a diagram illustrating an application of the present invention.

In addition, although the present invention is applied in the lighting system, the present invention may also be applied for improving the distortion problem when prism is used to change beam direction. Refer to FIG. 6, which illustrates an application of the present invention. In optical systems, the beam shape is circular 61 before the incident light passes through the prism 60. However, the beam shape becomes elliptic 62 after passing the prism 60 which is resulted from imperfect design of the prism 60. The problem can be solved by using the refractive optical element of the present invention. The refractive optical element is positioned ahead of the prism 60 so that the incident light passes the refractive optical element in advance and the beam shape is changed to elliptic 63 to compensate the distortion resulted from the prism 60. The compensated beam passing through the prism 60 becomes the circular shape 64 as the shape of the incident light.

Thus, the virtue of the present invention is applying low-cost and easy-controlled refractive optical elements in a lighting system. The light passes through the refractive optical elements which carry different curvature regions to adjust the size and the shape of the illuminated area. The design cost of the lighting system is indeed saved and the control system of the lighting system is also simplified. The present invention moves the relative position of the refractive optical elements to adjust the size and the shape of the illuminated area according to users' usage purposes or conditions. Besides, the refractive optical elements according to the present invention have continuous curvatures so the adjustment for the size or the shape of the illuminated area is gradually changed. Users feel more comfortable.

In addition, the refractive optical elements of the present invention may be applied for compensating the beam distortion resulted from prisms of an optical system.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A lighting system with an adjustable illuminated area comprising:

a light source for outputting a light;

a first refractive optical element and a second refractive optical element, wherein each of the first refractive optical element and the second refractive optical element is rectangular and is composed of a continuous curvature, and the first refractive optical element is movable along a first direction and the second refractive optical element is movable along a second direction perpendicular to the first direction;

wherein the light passes through the first refractive optical element and the second refractive optical element to form an illuminated area and the size and the shape of the illuminated area are adjusted when the relative position of the first refractive optical element and the second refractive optical element is adjusted.

2. The lighting system according to claim 1, wherein the surfaces of each of the first refractive optical element and the second refractive optical element form a convex region, a flat region and a concave region respectively.

3. The lighting system according to claim 2, wherein the size of the illuminated area is enlarged when the light passes through the concave region of the first refractive optical element and the concave region of the second refractive optical element.

4. The lighting system according to claim 2, wherein the shape of the illuminated area becomes elliptic when the light passes through the concave region of the first refractive optical element and the convex region of the second refractive optical element.

5. The lighting system according to claim 2, wherein the shape of the illuminated area becomes elliptic when the light passes through the convex region of the first refractive optical element and the concave region of the second refractive optical element.

6. The lighting system according to claim 2, wherein the size of the illuminated area is reduced when the light passes through the convex region of the first refractive optical element and the convex region of the second refractive optical element.

7. A control method for adjusting the size and the shape of an illuminated area of a lighting system, wherein the lighting system comprises a light source for outputting a light, a first refractive optical element and a second refractive optical element, wherein each of the first refractive optical element and the second refractive optical element is rectangular and is composed of a continuous curvature, wherein the light passes through the first refractive optical element and the second refractive optical element to form the illuminated area, comprising:

controlling the first refractive optical element to move along a first direction;

controlling the second refractive optical element to move along a second direction perpendicular to the first direction; and adjusting the relative position of the first refractive optical element and the second refractive optical element so that the size and the shape of the illuminated area are adjusted.

8. The control method according to claim 7, wherein the surfaces of each of the first refractive optical element and the second refractive optical element form a convex region, a flat region and a concave region respectively.

9. The control method according to claim 8, further comprising:

controlling the light to pass through the convex region of the first refractive optical element and the convex region of the second refractive optical element so that the size of the illuminated area is reduced.

10. The control method according to claim 8, further comprising:

controlling the light to pass through the concave region of the first refractive optical element and the concave region of the second refractive optical element so that the size of the illuminated area is enlarged.

11. The control method according to claim 8, further comprising:

controlling the light to pass through the convex region of the first refractive optical element and the concave region of the second refractive optical element so that the shape of the illuminated area becomes elliptic.

12. The control method according to claim 8, further comprising:

controlling the light to pass through the concave region of the first refractive optical element and the convex region of the second refractive optical element so that the shape of the illuminated area becomes elliptic.

* * * * *